United States Patent [19]

Budzich

[11] Patent Number: 4,747,335

[45] Date of Patent: May 31, 1988

[54] LOAD SENSING CIRCUIT OF LOAD COMPENSATED DIRECTION CONTROL VALVE

[75] Inventor: Tadeusz Budzich, Moreland Hills, Ohio

[73] Assignee: Caterpillar Inc., Peoria, Ill.

[21] Appl. No.: 945,149

[22] Filed: Dec. 22, 1986

[51] Int. Cl.[4] ..... F15B 13/16

[52] U.S. Cl. ..... 91/361; 91/436; 91/448; 137/596.13

[58] Field of Search ..... 60/393, 445, 452; 91/275, 361, 459, 436, 448, DIG. 2; 137/596.13, 596.1, 625.64

[56] References Cited

U.S. PATENT DOCUMENTS

| | | | |
|---|---|---|---|
| 3,744,517 | 7/1973 | Budzich | 137/596.2 |
| 4,074,529 | 2/1978 | Budzich | 60/445 |
| 4,139,987 | 2/1979 | Budzich | 60/452 X |
| 4,199,944 | 4/1980 | Budzich | 60/445 |
| 4,249,570 | 2/1981 | Budzich | 60/452 X |
| 4,437,388 | 3/1984 | Budzich | 91/446 |
| 4,488,474 | 12/1984 | Budzich | 91/446 |
| 4,610,194 | 9/1986 | Budzich | 91/446 |

FOREIGN PATENT DOCUMENTS

| | | | |
|---|---|---|---|
| 56-80511 | 7/1981 | Japan | 91/361 |
| 58-68504 | 4/1983 | Japan | 91/361 |

*Primary Examiner*—Robert E. Garrett
*Assistant Examiner*—George Kapsalas
*Attorney, Agent, or Firm*—J. W. Burrows

[57] ABSTRACT

A load sensing circuit of a load responsive direction control valve including a device for sensing load pressure signals identifying those load pressure signals as positive or negative and transmitting those identified positive or negative load pressure signals to the throttling compensator control of the load responsive valve, while also transmitting the positive load pressure signal to the pump control. The load pressure signals from individual cylinder ports, together with the signals related to the direction of displacement of the controlled load, are transmitted electrically to an electrical logic circuit, which identifies the load pressures as positive or negative and generates the required electrical signals to the electrohydraulic controls, which connect the positive or negative load pressure to throttling compensator controls of the load responsive direction and flow control valve.

15 Claims, 1 Drawing Sheet

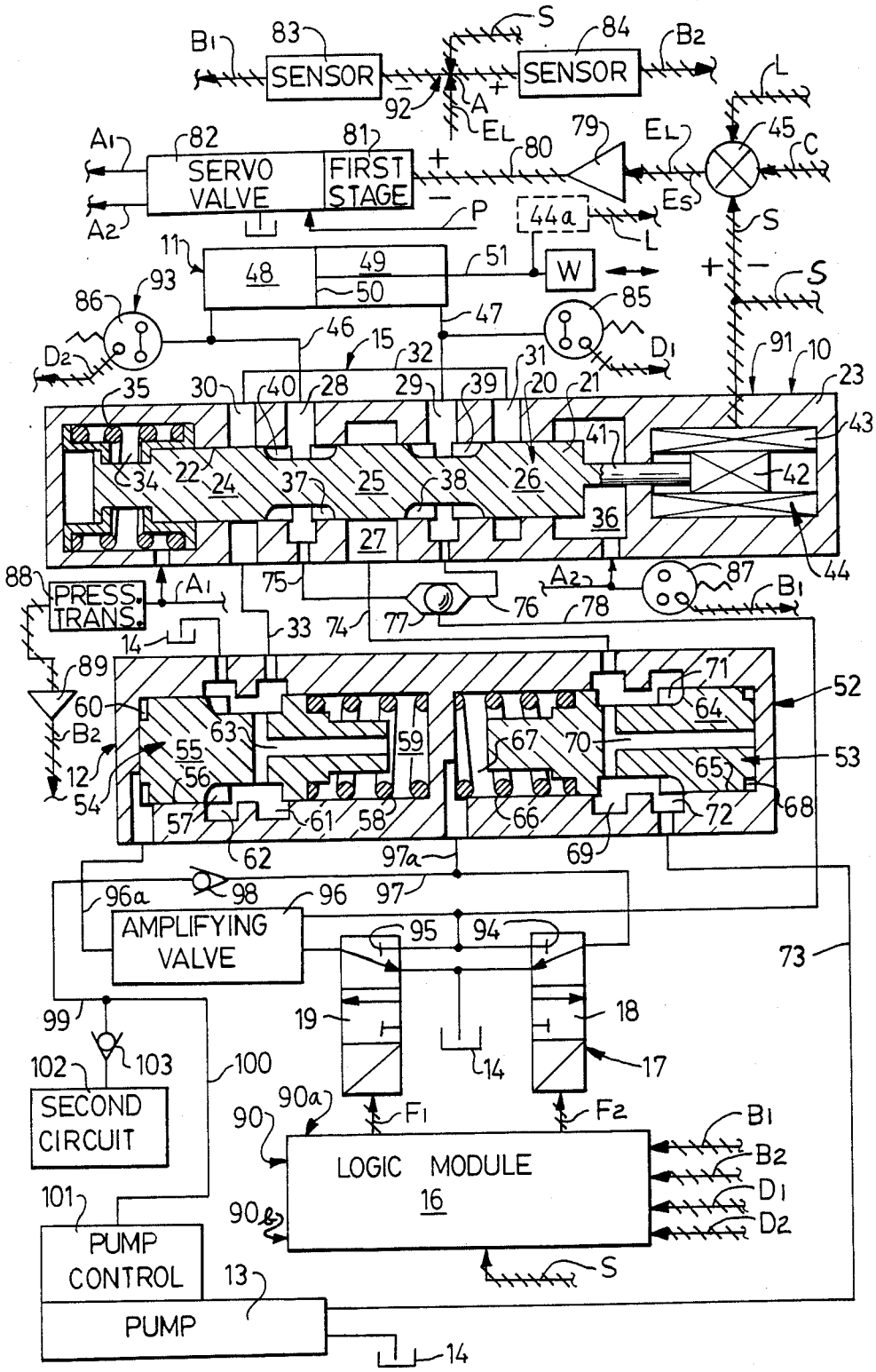
SENSOR
SENSOR
SERVO VALVE
FIRST STAGE
PRESS. TRANS.
AMPLIFYING VALVE
SECOND CIRCUIT
PUMP CONTROL
PUMP
LOGIC MODULE
16

LOAD SENSING CIRCUIT OF LOAD COMPENSATED DIRECTION CONTROL VALVE

BACKGROUND OF THE INVENTION

This invention relates generally to the load sensing controls of a load responsive system.

In more particular aspects this invention relates to positive and negative load pressure identifying and transmitting control for use in load responsive systems.

In still more particular aspects this invention relates to positive and negative load pressure identifying and transmitting controls, which can respond with direction control spool in its neutral position, in anticipation of the system demand.

In still more particular aspects this invention relates to positive and negative load pressure identifying and transmitting controls, in which the load pressure and load direction signals are transmitted for identification to an electrical circuit.

SUMMARY OF THE INVENTION

It is therefore a principal object of this invention to provide a load pressure sensing, identifying and transmitting circuit, capable of transmitting identified load pressure signals to the compensator and pump controls, in anticipation of the displacement of the direction control spool, permitting the throttling controls to assume their throttling control position, before the direction and flow control spool is moved from its neutral position.

It is a further object of this invention to provide a load pressure sensing, identifying and transmitting circuit in which the pressure and load direction signals are transmitted electrically to an electrical logic circuit.

It is another object of this invention to generate from the electrical logic circuit control signals to the electrohydraulic controls, to connect the positive and negative load throttling compensators with the positive or negative load pressure.

It is another object of this invention to provide a load pressure signal identifying circuit, which does not use the energy supplied to control the position of the direction control spool, completely eliminating the deadband effect, in systems using feedback of direction control spool position.

Briefly, the foregoing and other additional objects and advantages of this invention are accomplished by providing a novel load pressure sensing, identifying, and transmitting circuit with minimum attenuation of the load pressure control signals, while the deadband of the direction and flow control spool is not affected.

DESCRIPTION OF THE DRAWING

The drawing shows an embodiment of a single stage, compensated, direction control valve, responding to electrical control signals, together with a sectional view of direction and flow control valve section and compensating control section, with schematically shown fluid motor, electrohydraulic servo valve, solenoid valves, electric logic module, system pump and system reservoir, all connected by schematically shown system fluid conducting lines and electrical connections.

DESCRIPTION OF THE PREFERRED EMBODIMENT

Referring now to the drawing, an embodiment of a direction and flow control valve, generally designated as 10, is shown interposed between a fluid motor of a cylinder type, generally designated as 11, and a compensating control assembly, generally designated as 12, supplied with fluid power from a pump 13 and connected to system reservoir 14, which constitutes part of an exhaust system, generally designated as 15. An external electric logic module 16 is functionally interconnected to the flow control valve 10 and transmits identified load pressure signals through second valve means, generally designated as 17, including solenoid valves 18 and 19 to the compensating control assembly 12.

The flow control valve 10 includes first valve means, generally designated as 20, which includes a valve spool 21 of a four way type, which is axially guided in a bore 22, provided in a housing 23. The valve spool 21 is provided with lands 24, 25, and 26, which in neutral position of the valve spool 21, as shown on the drawing, isolate a fluid supply chamber 27, load chambers 28 and 29 and outlet chambers 30 and 31, which are interconnected by line 32 and connected by line 33 to the compensating control 12 and constitute part of the exhaust system 15. The land 24 of the valve spool 21 protrudes into a control chamber 34, subjected to pressure of control signal $A_1$ and engages a centering spring assembly 35, well-known in the art. The land 26 of the valve spool 21 protrudes into a control chamber 36, which is subjected to the pressure of control signal $A_2$. The lands 24, 25, and 26 of the valve spool 21 are provided with inflow, or positive load pressure metering slots 37 and 38 and with outflow or negative load pressure metering slots 39 and 40. The valve spool 21 is connected by extension 41 with a core 42, positioned within a coil 43 of a spool position transducer, generally designated as 44, which can be of any type known in the art and which generates spool position signal S to a differential amplifier 45, well-known in the art.

The load chambers 28 and 29 are connected by lines 46 and 47 with cylindrical spaces 48 and 49, which are separated by a piston 50, connected by piston rod 51 with a load W.

The compensating control assembly 12, together with positive load metering slots 37 and 38 and negative load metering slots 39 and 40, constitutes flow control means 52, which is equipped for compensation of positive and negative loads and is provided with a positive load pressure compensated control, generally designated as 53, and a negative load pressure compensated control, generally designated as 54.

The negative load pressure compensated control 54 is provided with a throttling member 55, axially slidable in a bore 56, provided with throttling slots 57, and biased by a control spring 58 located in a control chamber 59. One end of the throttling member 55 is subjected to pressure in a control chamber 60 and, in position as shown in the drawing, interconnects an inlet chamber 61 and an exhaust chamber 62, while throttling slots 57 remain in a fully open non-throttling position. The inlet chamber 61 is connected by passage 63 with the control chamber 59. The inlet chamber 61 is also connected by line 33 with the exhaust system 15, while the exhaust chamber 62 is connected to the system reservoir 14.

The positive load pressure compensated control 53 is provided with a throttling member 64, guided in a bore 65, biased by a control spring 66, positioned in a control chamber 67. One end of the throttling member 64, as shown in the drawing, is subjected to the pressure in a control chamber 68, which is connected to a second fluid supply chamber 69 by passage 70. The throttling member 64 is provided with throttling slots 71 and, in position as shown in the drawing, interconnects the second fluid supply chamber 69 with an inlet chamber 72, while throttling slots 71 remain in a fully open non-throttling position. The inlet chamber 72 is connected by line 73 with the outlet of the pump 13, while the second supply chamber 69 is connected by line 74 with the fluid supply chamber 27.

The load chambers 28 and 29 are connected by lines 75 and 76 with a logic shuttle 77, well-known in the art, which communicates the higher of the two pressures, existing in the load chambers 28 and 29, through line 78 to the solenoid valves 18 and 19.

The differential amplifier 45, can be subjected to either spool position signal S from the spool position transducer 44, or can be subjected to load position signal L from the transducer **44*a*, and to the command signal C, in a well-known manner, produces an error signal $E_L$ or $E_S$, which is amplified by an amplifier 79 and transmitted by line 80 to a first stage 81 of an electrohydraulic servo valve 82, well-known in the art. The amplified error signal in the line 80 can be positive or negative, depending on the required direction of correction of the position of the load W and will produce hydraulic pressure signal $A_1$ and $A_2$. When load position transducer 44*a* is used the sign of the error signal $E_L$ is determined at point A. If feedback signal S from the position of the spool 21 is used the direction of displacement of the spool 21 from its neutral position determines whether the feedback signal S is positive or negative. The feedback signal S is delivered to point A. The positive sign of the signals $E_L$ or S is sensed and amplified by a sensor 83 and produces a control signal $B_1$. The negative sign of the signals $E_L$ or S is sensed and amplified by a sensor 84 and produces a control signal $B_2$. The load pressure in line 47, which interconnects cylindrical space 49 of the fluid motor 11 with the load chamber 29, is sensed by a pressure switch 85, or a pressure transducer, both well-known in the art, and produces a control signal $D_1$. The load pressure in line 46, which interconnects cylindrical space 48, of the fluid motor 11, with the load chamber 28, is sensed by a pressure switch 86, or pressure transducer, both well-known in the art, and produces a control signal $D_2$. The existence of pressure in the control chamber 36 is sensed by the pressure switch 87 and produces a control signal $B_1$., the relationship between the control signals $B_1$ produced by pressure switch 87 and the sensor 83 will be explained later in the text. The pressure transducer 88, in response to the pressure in the control chamber 34, produces a signal, which is amplified by an amplifier 89** and which becomes the signal $B_2$.

In the drawing the differential amplifier 45 is shown supplied with two feedback signals L and S from the load position transducer **44*a* and spool position transducer 44. With single differential amplifier 45 only one feedback signal L or S can be used at one time. The selection of different feedback signals results in different control systems using different methods of obtaining the signal indicating the direction of the spool displacement, which is an essential input to the electric logic module 16**.

The electric logic means 90, including the electric logic module 16, subjected to $B_1$, $B_2$, $D_1$ and $D_2$ control signals and generating $F_1$ and $F_2$ control signals, will be described later in the specification. The electric logic module 16, under certain conditions can also be supplied directly with the spool position feedback signal S.

A positive load pressure identifying means 90A responds to the presence at one time, of $B_1$ and $D_1$ or $B_2$ and $D_2$ signals, which through the electrical network of the electric logic module generate the control signal $F_2$.

A negative load pressure identifying means 90B responds to presence, at one time, of $B_1$ and $D_2$ or $B_2$ and $D_1$ signals, which through the electrical network of the electric logic module 16, generate the control signal $F_1$.

Actuating means 91 constitutes a combination of different control elements of the control system, as shown on the drawing, which includes positive load metering slots 37 and 38 and negative load metering slots 39 and 40, with force generating cross-sectional areas protruding into the control chambers 34 and 36 of the first valve means 20, together with the electrohydraulic servo valve 82 and the $B_1$ and $B_2$ signal generating controls, which may include the differential amplifier 45, the spool position transducer 44 and load position transducer **44*a***.

First signal generating means 92 of the control system, as shown on the drawing, relate to the direction of displacement of the valve spool 21 and generate a $B_1$ or $B_2$ control signal, either by the sensor 83 or 84, in response to signals $E_L$ or S, or the pressure switch 87, or the pressure transducer 88, indicating the presence of pressure in the control chamber 34 or 36. As will be described later in the specification, the sign of the signals $E_L$ or S, or the presence of pressure in the control chamber 34 or 36, is directly related to the direction of displacement of the valve spool 21.

Second signal generating means 93 consists of pressure switch 85 or 86, which generates control signal $D_1$ or $D_2$, indicating the presence of load pressure in either the load chamber 28 or 29.

The solenoid valve 18, responsive to the control signal $F_2$ in its unactuated position, is provided with blocking means 94, which sever communication between the load pressure, transmitted by line 78 and the control chamber 67 of the positive load pressure compensated control 53, while the control chamber 67 is connected by the solenoid valve 18 to the system reservoir 14. With generation of the control signal $F_2$, the solenoid valve 18 connects the load pressure in line 78 with the control chamber 67, thus activating the positive load compensating system of the compensating control 12.

The solenoid valve 19, responsive to the control signal $F_1$ in its unactuated position, is provided with blocking means 95, which sever communication between the load pressure transmitted by line 78 and the control chamber 60 of the negative load pressure compensated control 54, while the control chamber 60 is connected by the solenoid valve 19 to the system reservoir 14. With generation of the control signal $F_1$, the solenoid valve 19 connects the load pressure in line 78 with the control chamber 60, thus activating the negative load compensating system of the compensating control 12. A schematically shown flow amplifying valve 96, well-known in the art, may be interposed between the solenoid valve 19 and the negative load pressure compensated control 54. An identical valve may also be interposed between the solenoid valve 18 and the positive load pressure compensated control 53.

Upon actuation of the solenoid valve 18, the positive load compensating system is activated and the positive load pressure signal, in a well-known manner, is transmitted through line 97, the check valve 98, lines 99 and 100 to a load responsive control 101 of the pump 13. Also, in a well-known manner, the positive load pressure signal can be transmitted to the load responsive control 101 from a load responsive circuit 102 through a check valve 103 and line 100.

With the valve spool 21 maintained in its neutral position, as shown in the drawing, by the centering spring assembly 35, the load chambers 28 and 29 are completely isolated from the supply chamber 27 and outlet chambers 30 and 31. At the same time, the connection from the load chambers 28 and 29 through the shuttle logic 77 and line 78 is blocked by blocking means 94 and 95. Under those conditions, depending on its direction, the load W will be supported by a pressure, generated in cylindrical space 48 or cylindrical space 49, acting on the cross-sectional area of the piston 50 of fluid motor 11 and cylindrical spaces 48 and 49 are completely isolated from each other with the load W remaining stationary.

Assume that the valve spool 21 is displaced by the pressure in the control chamber 34, generated by the control signal $A_1$, against the centering force of the centering spring assembly 35 from left to right, connecting the load chamber 28 through the positive load metering slot 37 with the supply chamber 27, while also connecting the load chamber 29 through the negative load metering slot 39 with the outlet chamber 31. This direction of the displacement of the valve spool 21 automatically dictates the direction of displacement of the load W, through the action of the fluid motor 11 and this direction of displacement of the load W must take place from left to right. Under those conditions, if the direction of the load W is such that it is supported by the pressure in the cylindrical space 48 of the fluid motor 11, the load W must be moved from left to right by the energy supplied from the pump 13 and through the flow of pressurized fluid from the supply chamber 27 to the cylindrical space 48, while the cylindrical space 49, subjected to low pressure, is connected by the valve spool 21 to the outlet chamber 31. Under those conditions, since displacement of the load W must be accomplished by the energy supplied from pump 13, the load W is called positive.

With the direction of displacement of the load W from left to right, as predetermined by the direction of displacement of the valve spool 21, if the direction of the load W is such that it is supported by the pressure in the space 49 of the fluid motor 11, the potential energy stored in the load W will be used for displacement of the load and the pressurized fluid, from the load chamber 29, will be throttled, on its way to the system reservoir and no energy has to be supplied from the pump 13 to cylindrical space 48, to cause displacement of the load W. Under those conditions, since displacement of the load W will be accomplished by the energy supplied from the load itself, the load W is called negative. Therefore, both the direction of displacement of the valve spool 21 and the direction of the force developed by the load W will determine if the load W is positive or negative.

With the direction control spool 21 displaced by the pressure in the control chamber 36 provided by the control signal $A_2$ against the centering force of the centering spring assembly 35 from right to left, the load chamber 29 through the positive load metering slot 38, will be connected to the supply chamber 27 and the load chamber 28 will be connected through the negative load metering slot 40 to the outlet chamber 30. This direction of displacement of the valve spool 21 will automatically determine the displacement of the load W from right to left. Again, as previously described, with this specific direction of displacement of the valve spool 21, the direction of the force developed by the load W will determine whether the load W is positive or negative. Therefore, as previously stated, under all operating conditions, both the direction of displacement of the valve spool 21 and the direction of the force developed by the load W will determine whether the load W is positive or negative.

In load responsive compensated systems wellknown in the art, control of the load is accomplished by the throttling action of the load responsive controls, which maintain a constant pressure differential across a metering orifice, interposed between the fluid motor controlling the load and the system itself. If the load is positive, the throttling action of those load responsive controls takes place between the system pump and the metering orifice. If the load is negative, the throttling action of those load responsive controls takes place between the metering orifice and the system reservoir. Since different types of throttling controls are used in the control of positive and negative loads, and since those controls are responsive to the magnitude of the load pressure, it is essential for proper operation of the system, not only to identify the type of load being controlled as being positive or negative, but also to transmit the load pressure signals to the positive or negative load responsive throttling controls of the system, with minimum attenuation of those signals. By the very nature of the determination of the type of the load, in respect to the direction of the load displacement at any specific time, the load can only be either positive or negative, necessitating the control action at a time, either of the positive or negative load responsive throttling controls.

The control action of the positive and negative load throttling controls of the control system of my U.S. Pat. No. 3,744,517 is essentially the same as that of the controls of the valve assembly of the present invention. However, in my U.S. Pat. No. 3,744,517, the identification of the type of load, be it positive or negative, and transmittal of the positive or negative load pressure signal to the appropriate positive or negative load throttling control, is accomplished by the displacement of the direction control spool in respect to negative or positive load sensing ports connected to load pressure signal conducting passages. This method of identification and transmittal of the positive and negative load pressure signals is well-known in the art and results not only in a well-known increase in the so-called deadband of the valve, but also produces the undesirable effect of a slower response of the load responsive throttling controls. Those load responsive controls may be either the positive or negative load throttling controls of the control valve itself, or when combined with the check valve logic system, well-known in the art, may be the load responsive controls of the system pump.

In the control of the present invention, identification of electrically transmitted load pressure signals as positive or negative and interconnection of identified load pressure to the positive and negative load throttling controls of valve assembly is accomplished by the electric logic module 16 in combination with solenoid operated valves 18 and 19.

The electrical control signals $B_1$, $B_2$, $D_1$ and $D_2$ are generated within the circuit and are transmitted to the electric logic module 16, which in response to the above control signals, generates either an electric output signal $F_1$ to three way solenoid valve 19, or an electric output signal $F_2$ to three way solenoid valve 18.

Only one of the B type signals $B_1$ or $B_2$ and one of the D type signals $D_1$ or $D_2$ can be generated at one time. There are only four possible combinations of those signals, one combination occurring at one time and resulting in generation of either $F_1$ or $F_2$ control signal.

Generation of the $F_1$ control signal, which results in actuation of the three-way solenoid valve 19, connects the load pressure through the logic shuttle 77 to the negative or aiding load pressure compensated control 54. Generation of $F_2$ control signal results in actuation of the three way solenoid valve 18, which connects the load pressure through the logic shuttle 77 to the positive or opposing load pressure compensated control 53.

The control signals $B_1$ and $B_2$ establish the intended direction of displacement of the load W controlled by the fluid motor 11. There are three different ways that those $B_1$ and $B_2$ control signals can be generated.

The differential amplifier 45 of the positioning servo system receives the command signal C and either the feedback signal S or the feedback signal L and produces the error signal E, which is amplified by the amplifier 79 and transmitted to the servo valve 82, which can be of a flapper nozzle, jet pipe or any other type and which generates the hydraulic control signals $A_1$ and $A_2$, which are proportional to the error signal E. The control output signals $A_1$ and $A_2$ determine the position of the valve spool 21 and therefore the position of the load W. Depending on the direction of the required correction in the position of the load W, signal $E_L$ and S will be either positive or negative. The presence of negative signal $E_L(-)$ or $S(-)$ is determined by the sensor 83, which generates a control signal $B_1$. The presence of positive signal $E_L(+)$ or $S(+)$ is determined by the sensor 84, which generates a control signal $B_2$. The electronic sensors 83 and 84 must respond to the sign of signal $E_L$ or S at a voltage level as small as possible, but well above the electrical noise level and must generate $B_1$ or $B_2$ signal, without affecting the error signal $E_L(+/-)$ or signal $S(+/-)$, transmitted to the differential amplifier 45. Those sensors 83 and 84 are made from standard components like for example, diodes, amplifiers, etc., well-known in the art.

The control signals $B_1$ and $B_2$ can also be generated either by conventional pressure switches or pressure transducers, which determine the presence of pressure at the ends of the valve spool 21, which determines the direction of displacement of the valve spool 21 and therefore the direction of displacement of the load W.

The $D_1$ and $D_2$ control signals are generated by pressure switch 85 or 86, in response to load pressure in load chamber 28 or 29, which is the pressure necessary to support the load W. The presence of this load pressure can be established either by pressure switches or by pressure transducers, similar to those used in generation of $B_1$ and $B_2$ signals.

The electric logic module 16, using standard components like nand gates and nor gates or double throw single pole relays, well-known in the art, in response to the control signals of either B or D type, must generate F type signals, at a sufficient energy level to actuate either the three way solenoid valve 18 or 19.

The presence of $B_1$ and $D_2$ signals must generate $F_1$ signal—negative load control.

The presence of $B_1$ and $D_1$ signals must generate $F_2$ signal—positive load control.

The presence of $B_2$ and $D_2$ signals must generate $F_2$ signal—positive load control.

The presence of $B_2$ and $D_1$ signals must generate $F_1$ signal—negative load control.

The B type signal establishes the direction of correction of the position of the load W, while the presence of $D_1$ or $D_2$ pressure in relation to the desired direction of correction of the load position establishes if the load W is of an opposing or aiding type. Therefore, once the type of load to be controlled is established, either the opposing load pressure compensated control 53, or the aiding load pressure compensated control 54 is activated, through actuation of the appropriate solenoid valve responding to $F_1$ or $F_2$ control signal. In a manner well-known to those skilled in the art, the input and output signals, supplied to and generated by the electric logic module 16, can be properly conditioned for optimum performance of the logic circuit. Irrespective of the magnitude of $A_1$ and $A_2$ pressure levels, if the position of the valve spool 21 is controlled by the pressure differential between those pressures, the magnitude of this pressure differential may not necessarily reflect the direction of the displacement of the valve spool 21 from its neutral position. Therefore, when $B_1$ and $B_2$ signals, generated by the pressures in the control chambers 34 and 36 are used, those signals might have to be referenced to the actual spool position and therefore the input S from the spool position transducer 44 to the electric logic module 16 may be necessary.

With positive load pressure signal transmitting circuit transmitting a positive load pressure signal from either load chamber 28 or 29, with valve spool 21 displaced in either direction, the control chamber 67 will be subjected to positive load pressure, while the control chamber 68 will be subjected through passage 70 to pressure in the second fluid supply chamber 69. Then the throttling member 64 will assume a modulating position, throttling by positive load throttling slots 71, the flow of fluid from the inlet chamber 72 connected to the pump 13 to the second fluid supply chamber 69, to automatically maintain a constant pressure differential, equivalent to preload in the control spring 66 across an orifice, caused by the displacement of the positive load metering slot 37 or 38.

With the negative load pressure signal transmitting circuit transmitting a negative load pressure signal from either load chamber 28 or 29, with valve spool 21 displaced in either direction, the control chamber 60 will be subjected to negative load pressure, while control chamber 59 will be subjected to the pressure of outlet chamber 30, or outlet chamber 31. Then the throttling member 55 will assume a modulating position, throttling by negative load throttling slots 57, the flow of fluid from the inlet chamber 61 to the exhaust chamber 62, to automatically maintain a constant pressure differential, equivalent to the preload in the control spring 58 across an orifice caused by the displacement of the negative load metering slot 39 or 40.

Assume that either the control pressure differential between $A_1$ and $A_2$ control pressure signals or that the control pressure signal $A_1$ or $A_2$ is small enough so that it will not overcome the preload in the centering spring 35, but at the same time is large enough to produce $B_1$ or $B_2$ control signals and through the electric logic module 16 actuate the solenoid valve 18 or 19, activating the positive or negative load control circuits. The presence of such a small control signal $A_1$ or $A_2$ or control pressure differential between those signals will not cause the displacement of the valve spool 21, but will, in a manner as previously described, fully activate the positive and negative load pressure transmitting circuits. Therefore, with the valve spool 21 in its neutral position in anticipation of a control signal strong enough to displace the valve spool 21, either the positive or negative load throttling controls will be fully activated and will assume an equilibrium control position equivalent to flow through a control orifice of zero area. Any displacement of the valve spool 21 from its neutral position will create a metering orifice, with an appropriate positive or negative load throttling control already fully activated and in a modulating position, requiring only minimal displacement to control the pressure differential across the orifice. This anticipation feature is unique and extremely beneficial, since it provides a very fast responding and stable control with linear control characteristics.

The electrical load pressure identifying and transmitting circuit of the present invention permits not only the use of the valve spool 21 with essentially a zero deadband, but it also greatly simplifies the design of the valve spool 21 and the housing 23. In the absence of the control pressure signals $A_1$ and $A_2$, the load chambers 28 and 29 and therefore cylindrical spaces 48 and 49 of the fluid motor 11 are completely isolated by the valve spool 21 and by blocking means 94 and 95 of solenoid valves 18 and 19.

Generation, transmittal, and identification of electrical load pressure signals, together with the use of solenoid valves, one for connecting the positive load pressure and one for connecting the negative load pressure to the compensating controls of the load responsive valve, results in an exceptionally stable control system with a very high frequency response. The positive and negative load pressure solenoid valves can be directly mounted on the positive and negative load compensators, providing minimal attenuation of the control pressures at high rates of flow. In a well-known manner, the flow amplifying valve 96, well-known in the art, can be interposed between each of the solenoid valves and respective compensating controls. With the use of such flow amplifying valves, the size of the solenoid valves can be decreased, in turn increasing their response, while also increasing the transient and frequency response of the compensating controls. By the use of electrically transmitted load pressure signals and solenoid valves, not only a large number of drilled passages can be eliminated, simplifying the valve housing and placement of the compensating controls, but also throttling losses and signal attenuation associated with such drilled passages is completely dispensed with, thus increasing the response of these controls.

The identification of the direction of displacement of the valve spool 21 from its neutral position is one of the essential factors in determination of whether the controlled load is of a positive or negative type. As previously described this identification of the direction of displacement of the valve spool 21 can be established by the pressures in control chambers 36 and 34, which in turn are determined by the force developed by the centering spring assembly 35.

When using an electrical method of determination of the spool position, which may be provided by position transducers, well known in the art, like for example, potentiometer, LVDT etc., one such transducer being shown in FIG. 1 as 44, the control signal S can be directly supplied to the electrical logic module 16. Then $B_1$ signal can be, for example, substituted by negative S signal and $B_2$ substituted by positive S signal. In such a system the spool position control signals can be used as spool position feedback signal as a direct input to the differential amplifier 45, in control of the position of the valve spool 21.

With electrically generated spool position signal S the centering spring assembly 35 may not be necessary, although it is useful for returning the valve spool 21 to its neutral position, during failure of electrically operated $B_1$ and $B_2$ signal generating system.

The direction of displacement from its neutral position of the valve spool 21 can also be determined from the sign of the error signal $E_L$, from the differential amplifier 45, if the feedback to such differential amplifier is provided from a transducer **44*a***, connected to the system load.

The control system, as shown on the drawing in determination of the direction of displacement of spool 21 from its neutral position, can use, only at one time, either load position transducer **44*a* and L feedback signal, or spool position transducer 44 and S feedback signal. In the first case the electric logic module 16 is made responsive to the sign of the load position error signal $\pm E_L$, which generates $B_1$ and $B_2$ control signals. In the second case the electric logic module 16** is made directly responsive to the sign of spool position feedback signal $\pm$S, which then generates $B_1$ and $B_2$ control signals.

Although the preferred embodiments of this invention have been shown and described in detail, it is recognized that the invention is not limited to the precise form and structure shown and various modifications and rearrangements as will occur to those skilled in the art upon full comprehension of this invention may be resorted to without departing from the scope of the invention as defined in the claims.

I claim:

1. In a load responsive system including a fluid power actuator operable to control a positive or negative load W, a source of pressure fluid, fluid exhaust means, flow control means of said load responsive system including a positive and a negative load pressure throttling control and first valve means operable to selectively interconnect said actuator with said source of pressure fluid and said fluid exhaust means and to direct the flow of fluid subjected to positive type and negative type load pressures, actuating means responsive to a control signal and operable to control direction of displacement and position of said first valve means, first signal generating means operable to generate a first electrical signal in response to direction of displacement of said first valve means, second signal generating means operable to generate second electrical signal in response to said laod pressure in said fluid power actuator, electric logic means having a positive and a negative load pressure identifying means and operable to process said first and said second electrical signals and to identify the type of said load pressure and operable to produce at least one actuating signal, and second valve means responsive to said actuating signal and operable to supply said identified load pressure to the respective positive or negative load pressure throttling control.

2. A load responsive system, as set forth in claim 1, wherein said second valve means has first conducting means operable to connect said positive load pressure to a load responsive control of said source of pressure fluid.

3. A load responsive system, as set forth in claim 1, wherein said second valve means has second conducting means operable to connect said positive laod pressure to the positive load pressure throttling control of said flow control means of said load responsive system.

4. A load responsive system, as set forth in claim 1, wherein said second valve means has blocking means operable to isolate said positive load pressure from said positive load pressure throttling control in the absence of said actuating signal.

5. A load responsive system, as set forth in claim 1, wherein said second valve means has third conducitng means operable to connect said negative load pressure to the negative load pressure throttling control of said flow control means of said load responsive system.

6. A load responsive system, as set forth in claim 1, wherein said second valve means has blocking means operable to isolate said negative load pressure from said negative load pressure throttling control in the absence of a second actuating signal.

7. A load responsive system, as set forth in claim 1, wherein said second valve means is operative in responsive to said actuating signal to connect said positive or negative load pressure to the respective positive or negative load pressure throttling control of said flow control means of said load responsive system.

8. A load responsive system, as set forth in claim 1, wherein said second valve means has blocking means operable to isolate said positive and said negative load pressure from said flow control means in absence of said actuating signal.

9. A load responsive system, as set forth in claim 1, wherein shuttle valve means is interposed between said fluid power actuator and said second valve means.

10. A load responsive system, as set forth in claim 1, wherein said first signal generating means has means responsive to a positive or negative sign of an error signal supplied to said actuating means.

11. A load responsive system, as set forth in claim 1, wherein said first signal generating means has means responsive to the pressure output of said actuating means to generate the first electrical signal.

12. A load responsive system, as set forth in claim 1, wherein said second signal generating means has pressure switch means operable to detect the presence of pressure at said fluid power actuator.

13. A load responsive system, as set forth in claim 1, wherein said second valve means has first solenoid valve means responsive to the first actuating signal generated by said electric logic means due to presence of said positive load pressure and second solenoid valve means responsive to the second actuating signal generated by said electric logic means due to presence of said negative load pressure.

14. A load responsive system, as set forth in claim 1, wherein said electric logic means is operative in response to the first and second signal generating means to generate and transmit first and second actuating signals to said second valve means.

15. A load responsive system, as set forth in claim 1, wherein said first signal generating means has means responsive to a spool position feedback signal.

* * * * *